US006651754B1

(12) United States Patent
Hampton

(10) Patent No.: US 6,651,754 B1
(45) Date of Patent: Nov. 25, 2003

(54) APPARATUS FOR MOVING EARTH BORING MACHINES

(76) Inventor: Richard Hampton, P.O. Box 340, Brentwood, CA (US) 94513

( * ) Notice: Subject to any disclaimer, the term of this patent is extended or adjusted under 35 U.S.C. 154(b) by 0 days.

(21) Appl. No.: 10/058,624

(22) Filed: Jan. 28, 2002

(51) Int. Cl.[7] ..... B23Q 5/00

(52) U.S. Cl. ..... 173/152; 173/154; 173/159; 173/160

(58) Field of Search ..... 173/148, 152, 173/154, 159, 160, 164, 147

(56) References Cited

U.S. PATENT DOCUMENTS 2,948,520 A * 8/1960 Densmore ..... 299/55
3,026,948 A * 3/1962 Pettee ..... 173/187
3,118,509 A * 1/1964 Adams et al. ..... 173/160
3,155,171 A * 11/1964 Kurt et al. ..... 173/4
3,231,032 A * 1/1966 Genberg et al. ..... 175/171
3,232,360 A * 2/1966 Dickinson ..... 175/62
3,415,329 A * 12/1968 Marlind ..... 175/19
3,480,091 A * 11/1969 Gyongyosi ..... 173/160
3,587,755 A * 6/1971 Slusher ..... 173/159
3,610,345 A * 10/1971 Richmond ..... 173/154
3,679,006 A * 7/1972 Richmond ..... 173/152
3,696,874 A * 10/1972 Brinkman ..... 173/32
3,872,932 A * 3/1975 Gosselin ..... 173/1
3,912,024 A * 10/1975 Richmond et al. ..... 173/152
4,114,698 A * 9/1978 Webb et al. ..... 173/1
4,650,011 A * 3/1987 Barbieri ..... 175/18
5,228,525 A * 7/1993 Denney et al. ..... 175/122

* cited by examiner

*Primary Examiner*—Scott A. Smith
*Assistant Examiner*—Nathaniel Chukwurah
(74) *Attorney, Agent, or Firm*—Thomas R. Lampe

(57) ABSTRACT

Apparatus for moving an earth boring machine along a track includes a module which is releasably connected as a unit to the earth boring machine. The module includes a support plate releasably connected to the earth boring machine.

11 Claims, 4 Drawing Sheets

APPARATUS FOR MOVING EARTH BORING MACHINES

TECHNICAL FIELD

This invention relates to apparatus for transporting horizontal earth boring machines along track ways.

BACKGROUND OF THE INVENTION

Horizontal earth boring machines are utilized to bore holes or tunnels in the earth for a wide variety of purposes. Such machines are normally moved along and on track ways during the boring operation. It is necessary to periodically move the machines from the front to the rear of the bore pit, for example to install another section of casing or to remove augers from the casing.

Retraction cables associated with winches have often been utilized for such purpose. Because horizontal earth boring machines are quite heavy, tremendous stresses can be placed on the retraction cables and related equipment, creating a potentially dangerous situation.

A relatively recent development has been the use of motor driven wheels in association with the earth boring machine which engage the track way and are utilized to transport the machine in a direction away from the bore. In particular, a retraction system utilizing a hydraulic motor operating track way equipment wheels to retract an earth boring machine is made available by Barbco, Inc., and marketed under the name Fast Track. In that system, a track way engagement wheel is directly driven by a hydraulic motor. A continuous loop drive chain interconnects that track engagement wheel with another; that is, one track engagement wheel is directly driven by the motor and the other track engagement wheel is driven through a drive chain interconnecting the two wheels. This results in uneven forces or loads being applied to the wheels, a factor which lowers the efficiency of the system and promotes wear.

The Fast Trac system is completely disposed within the horizontal earth boring machine to which it is attached and is not readily accessible from outside the machine without partially dismantling the machine. Furthermore, the system is permanently affixed to the frame of the machine. Both of these factors make access to the system, for example to replace bushings, wheels, or other system parts, very difficult and time consuming.

DISCLOSURE OF INVENTION

The present invention relates to apparatus for moving an earth boring machine along a track which can readily be installed in modular form on the machine. The module also can readily be removed for maintenance or other purposes. The apparatus can be retrofitted to existing machines with very little structural modification or effort.

In addition, the apparatus incorporates an arrangement for driving first and second track engagement wheels employed therein which evens out the forces applied to the wheels by a hydraulic motor associated therewith. By evening out the load, the lives of bushings and other components of the system are extended.

The apparatus is for moving an earth boring machine along a track, the earth boring machine defining an opening.

The apparatus includes a module for releasable connection as a unit to the earth boring machine. The module comprises a support plate, a housing connected to the support plate, extending from a side of the support plate and defining a housing interior, a motor having a drive shaft attached to the support plate, at least one track engagement wheel rotatably mounted in the housing interior and projecting downwardly from the housing, and mechanical linkage interconnecting the at least one track engagement wheel and the drive shaft.

Releasable connector means is provided for releasably mounting the module on the earth boring machine with the housing projecting inwardly into the earth boring machine at the opening.

In the preferred embodiment disclosed herein, first and second track engagement wheels are rotatably mounted in the housing interior and project downwardly from the housing. The first and second track engagement wheels are spaced from one another. The mechanical linkage includes an endless drive element interconnecting the first and second transport wheels and the drive shaft.

Other features, advantages and objects of the present invention will become apparent with reference to the following description and accompanying drawings.

MODES FOR CARRYING OUT THE INVENTION

Figure 1:
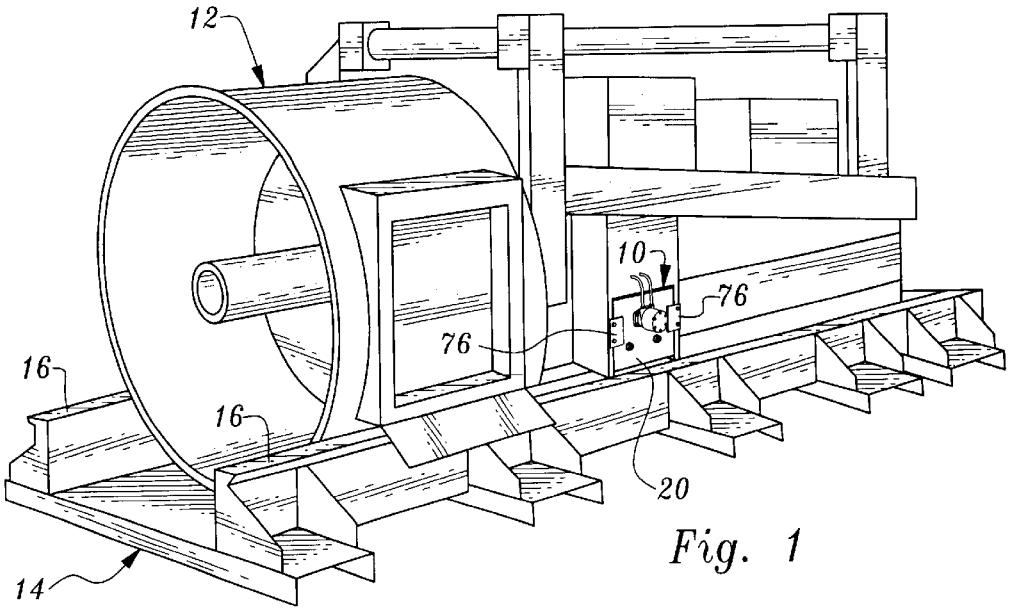
FIG. 1 is a perspective view illustrating a horizontal earth boring machine having apparatus constructed in accordance with the teachings of the present invention associated therewith.

Referring now to FIGS. 1–6, apparatus constructed in accordance with the teachings of the present invention is designated by reference numeral 10. Shown in its entirety in FIG. 1 is a horizontal earth boring machine 12 with which the apparatus is associated. Disposed under earth boring machine 12 is a track way 14 including two tracks 16 disposed side-by-side. Such track ways are conventional and the illustrated horizontal earth boring machine is also of a conventional nature and will not be described in detail.

An example of such a machine is the American Augers Model 36-340 boring machine; however, it is to be appreciated that the apparatus of the present invention may be suitably employed with any horizontal earth boring machine. Of course, an apparatus 10 is deployed on each side of the machine, each apparatus being associated with one of the tracks 16. Since the apparatus 10 is the same on both sides of the machine, only one such unit will be described in detail.

The apparatus of the present invention includes a module for releasable connection as a unit to the earth boring machine. The module includes a support plate 20, a housing 22 connected to the support plate, extending from a side of the support plate and defining a housing interior.

Also incorporated in the module and comprising a part thereof is a hydraulic motor 24 which is operatively connected to a suitable source of pressurized hydraulic fluid. The hydraulic motor 24 is connected by threaded fasteners to a side of the support plate 20 opposed to the side thereof from which the housing extends. The hydraulic motor includes a drive shaft 26 which projects through an opening or hole 28 in the support plate 20.

Included in the module are track engagement wheels 30, 32. The track engagement wheels may, if desired, include a metal interior portion 34 (see FIG. 6) and an outer portion 36 of some other material such as durable synthetic material.

Another component of the module is mechanical linkage in the form of an endless drive chain 40. A sprocket 44 is affixed to drive shaft 26 and engages the drive chain.

Track engagement wheels 30, 32 are supported respectively on axles 46, 48 which extend from holes or openings formed in the support plate 20 to openings formed in the housing 22. Preferably the axles have grease fittings 50 to provide lubricant. Bushings 60 having flanged ends are disposed between the wheels and the axles and rotate with the wheels.

Disposed about axles 46, 48 and locked against movement relative to track engagement wheels 30, 32 are sprockets 64, each of the sprockets 64 being threadedly engaged with a bushing 60. A washer 66 and a lock collar 68 are associated with each of the axles to the support plate and journal. Bearings are provided to support the ends of the axles 46, 48.

The drive chain 40 loops about the sprockets 44, 64. The drive shaft 66 is equidistant from axles 46, 48 so that the forces imparted to the track engagement wheels by the sprocket/drive chain combination from sprocket 44 is essentially of equal force.

When the module is installed in place on horizontal earth boring machine 12, the module is positioned in a recess formed in the machine extending inwardly from an opening 70. This opening can be cut into the frame of an existing machine to install the apparatus as a retrofit. Opening 70 has a vertical dimension somewhat greater than that of support plate 20 so that the module can move up and down to some extent.

Figure 2:
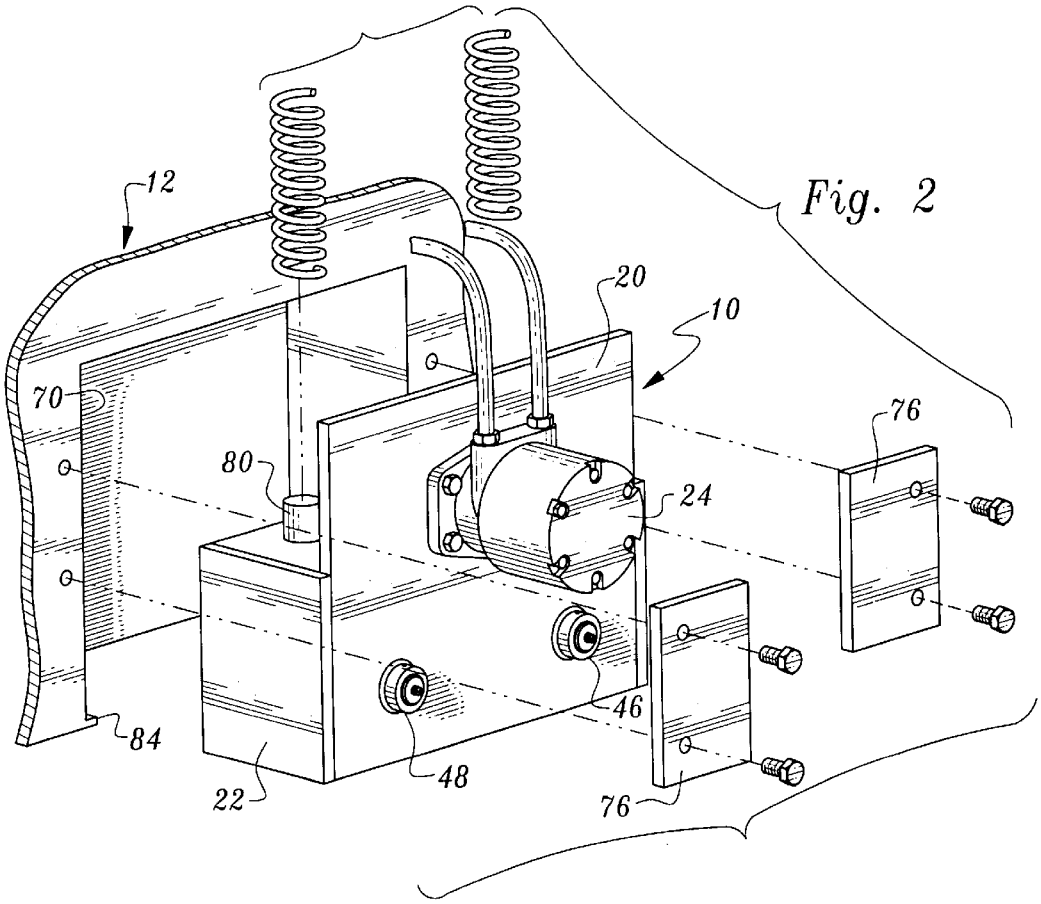
FIG. 2 is an exploded, perspective view showing a preferred form of the apparatus prior to installation thereof on the earth boring machine.
Figure 3:
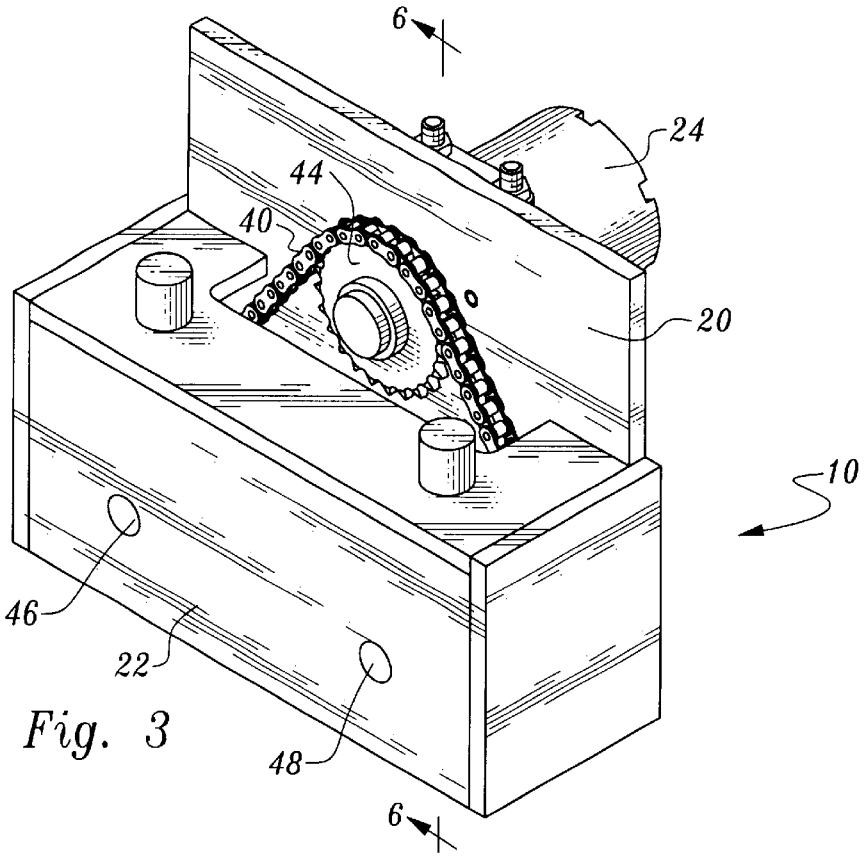
FIG. 3 is a perspective view of the module of the apparatus taken from the back or inner side thereof.
Figure 4:
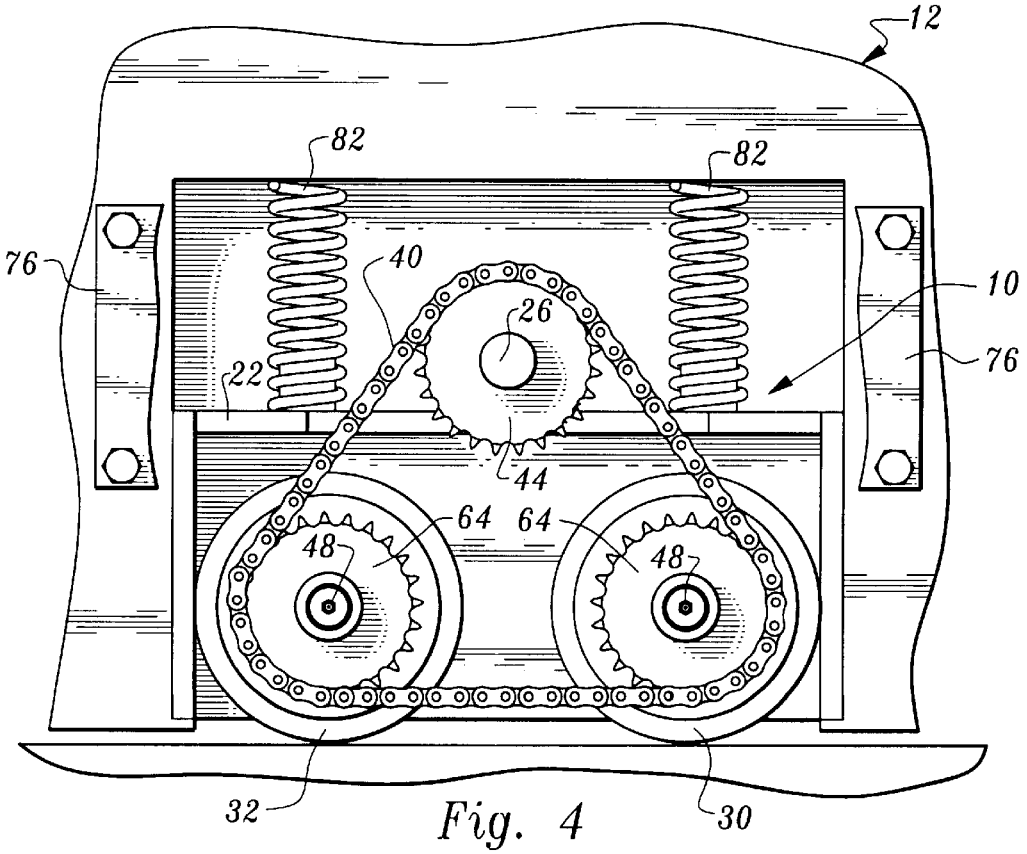
FIG. 4 is a frontal, elevational view illustrating selected components of the apparatus when installed, a support plate and hydraulic motor employed in the apparatus not being shown.
Figure 5:
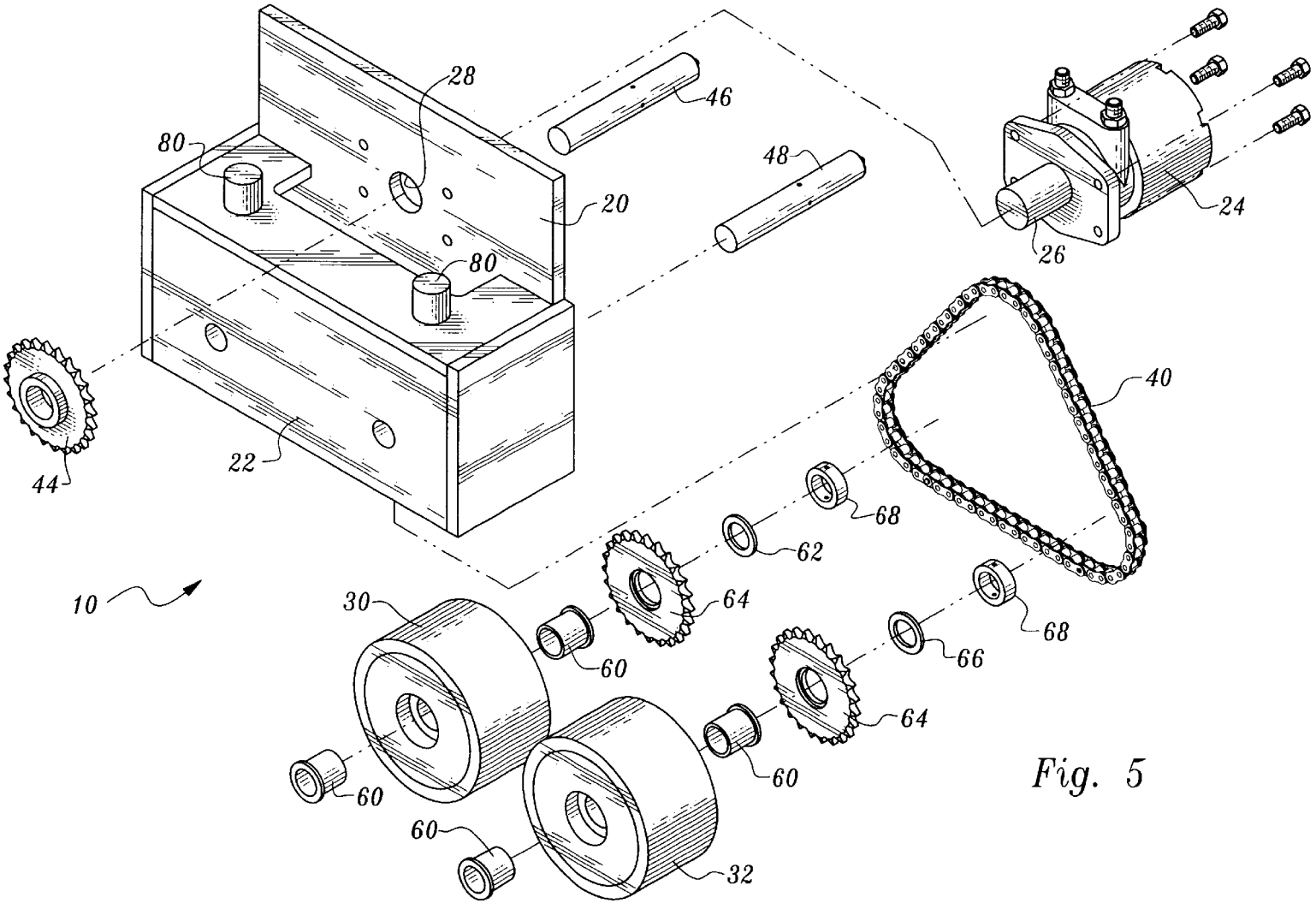
FIG. 5 is a perspective, exploded view illustrating components of the apparatus.

FIG. 2 shows the apparatus just prior to installation in a recess of the earth boring machine communicating with opening 70. When installed in place, the outer surface of the support plate 20 is essentially co-planar with the outer surface of the machine surrounding opening 70. After such installation has been accomplished, retainer plates 76 are fastened to the earth boring machine by mechanical fasteners. The retainer plates partially cover the opening and support plate to prevent the support plate from moving in an outward direction. In the arrangement illustrated, the hydraulic motor 24 is disposed externally so as not to occupy any of the recess, which may be restricted.

Positioned on top of housing 22 are two stud posts 80 which are received in the lower ends of compression springs 82. The tops of the springs 82 bear against the frame of the earth boring machine and exert downwardly directed biasing forces on the housing 22. Downward movement of the housing 22 and the rest of the module is limited by ledges or projections 84 formed at the bottom of the earth boring machine frame and extending inwardly from the opening. Springs 82 ensure a good contact between the track engagement wheels and the track, the wheels projecting downwardly from the bottom of the housing.

Replacement of any of the components of the module, such as the wheels, wheel parts or bushings, is a very easy matter indeed. The operator simply unfastens the retainer plates 76 from the machine and slides the module outwardly so that the inner mechanism is exposed. This must be compared with the current prior art situation wherein access to the permanently installed mechanism disposed at the inside of the earth boring machine can be obtained only with great difficulty.

Figure 7:
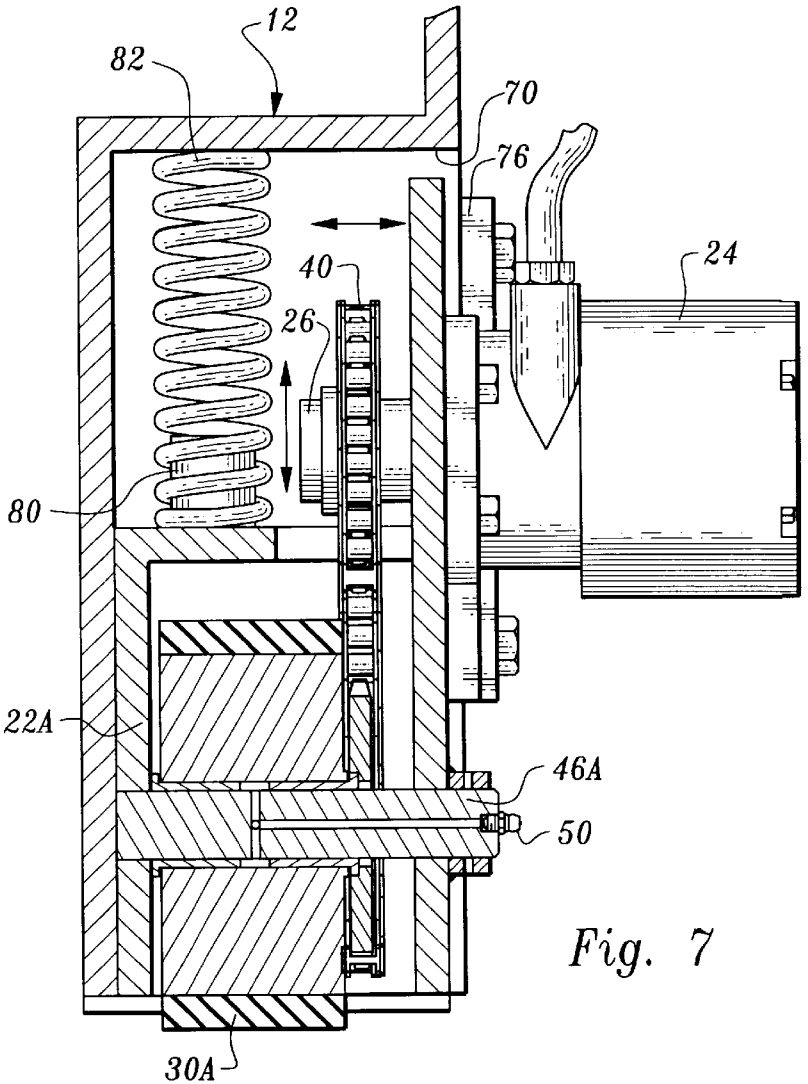
FIG. 7 is a view similar to FIG. 6, but illustrating an alternate embodiment of the invention.
Figure 6:
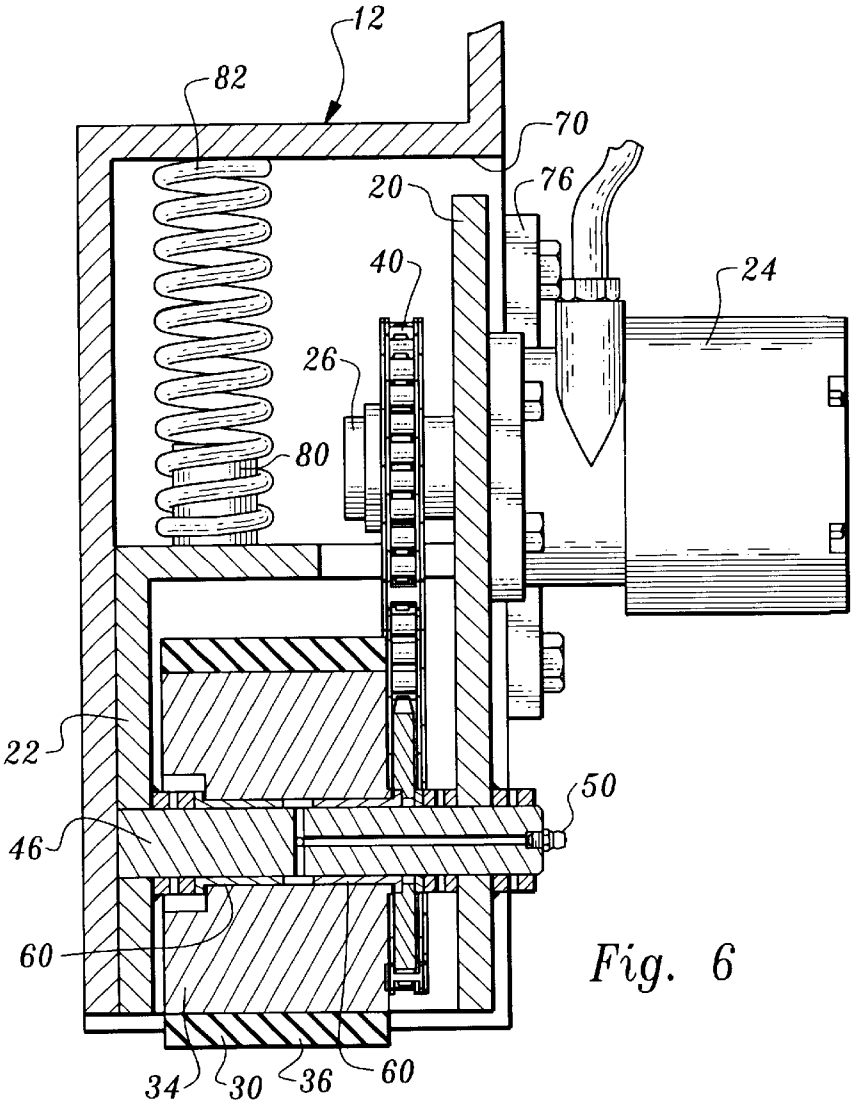
FIG. 6 is a cross-sectional view taken along the line 6—6 in FIG. 3.

FIG. 7 discloses an alternative embodiment of the apparatus which has a narrower configuration than that of FIGS. 1–6. This is to illustrate that the principles of the present invention can be incorporated in different sizes of modules to accommodate different sizes of earth boring machines. The double-headed arrows are to illustrate that components of the module may, if desired, be adjusted both vertically and horizontally to accommodate different configurations of earth boring machines.

The invention claimed is:

1. Apparatus for supporting and moving an earth boring machine in its entirety along a substantialy horizontal track, said apparatus comprising, in combination:

a module for releasable connection as a unit to the earth boring machine, the module comprising a support member, a housing connected to said support member, extending from a side of the support member and defining a housing interior, a motor having a drive shaft attached to said support member, first and second track engagement wheels rotatably mounted in said housing interior and projecting downwardly from said housing, and mechanical linkage interconnecting said first and second track engagement wheels and said drive shaft; and releasable connector means for releasably mounting said module on the earth boring machine with said housing projecting inwardly into the earth boring machine, said first and second track engagement wheels being supported in said housing interior by double-ended axles, the first and second track engagement wheels being spaced from one another, said mechanical linkage including an endless drive element interconnecting said first and second track engagement wheels and said drive shaft, and both ends of said axles being supported, with one end of each axle supported by said support member and the other end of each axle supported by said housing, and said axles extending across said housing interior.

2. The apparatus according to claim 1 wherein said endless drive element comprises a drive chain, said mechanical linkage additionally comprising sprockets attached to said first and second track engagement wheels and said drive shaft.

3. The apparatus according to claim 1 wherein said support member comprises a support plate and wherein said releasable connector means comprises spaced retention members for attachment to the earth boring machine to partially cover the support plate.

4. The apparatus according to claim 3 wherein said spaced retention members comprise retainer plates for releasable attachment to the earth boring machine adjacent to an opening formed in said earth boring machine, said retainer plates projecting from opposed sides of the opening.

5. The apparatus according to claim 1 wherein said motor is a hydraulic motor located on a side of the support member opposite the side of the support member from which said housing extends, said hydraulic motor being located externally of the earth boring machine when the module is releasably mounted on the earth boring machine by said releasable connector means.

6. The apparatus according to claim 1 additionally comprising biasing means biasing the housing in a downward direction.

7. The apparatus according to claim 6 additionally including stop means for limiting downward movement of the housing under the influence of said biasing means.

8. Apparatus for connection to an earth boring machine for supporting and for moving the earth boring machine in its entirety along a substantially horizontally disposed track, said apparatus comprising, in combination:

a support member;

a housing connected to said support member, extending from a side of the support member and defining a housing interior;

a motor having a drive shaft attached to said support member;

first and second track engagement wheels rotatably mounted in said housing interior and projecting downwardly from said housing, said first and second track engagement wheels being spaced from one another and disposed on double-ended axles extending completely across the housing interior and supported at both ends, one of ends of each axle supported by the support member and the other of the ends of each axle supported by the housing; and mechanical linkage interconnecting said first and second track engagement wheels and said drive shaft, said mechanical linkage including an endless drive chain disposed about sprockets attached to said first and second track engagement wheels and said drive shaft, said drive shaft being equidistant from the first and second track engagement wheels.

9. Apparatus for moving an earth boring machine along a track, said earth boring machine defining an opening, said apparatus comprising, in combination:

a module for releasable connection as a unit to the earth boring machine, the module comprising a support plate, a housing connected to said support plate, extending from a side of the support plate and defining a housing interior, a motor having a drive shaft attached to said support plate, at least one track engagement wheel rotatably mounted in said housing interior and projecting downwardly from said housing, and mechanical linkage interconnecting said at least one track engagement wheel and said drive shaft; and releasable connector means for releasably mounting said module on the earth boring machine with said housing projecting inwardly into the earth boring machine at said opening, said releasable connector means comprising spaced retention members for attachment to the earth boring machine to partially cover the opening in the earth boring machine and the support plate.

10. The apparatus according to claim 9 wherein said spaced retention members comprise retainer plates for releasable attachment to the earth boring machine adjacent to the opening, said retainer plates projecting from opposed sides of the opening.

11. Apparatus for moving an earth boring machine along a track, said earth boring machine defining an opening, said apparatus comprising, in combination:

a module for releasable connection as a unit to the earth boring machine, the module comprising a support member, a housing connected to said support member, extending from a side of the support member and defining a housing interior, a motor having a drive shaft attached to said support member, at least one track engagement wheel rotatably mounted in said housing interior and projecting downwardly from said housing, and mechanical linkage interconnecting said at least one track engagement wheel and said drive shaft;

releasable connector means for releasably mounting said module on the earth boring machine with said housing projecting inwardly into the earth boring machine at said opening;

biasing means biasing the housing in a downward direction; and stop means for limiting downward movement of the housing under the influence of said biasing means.

* * * * *